US006250521B1

(12) United States Patent
Assar

(10) Patent No.: US 6,250,521 B1
(45) Date of Patent: Jun. 26, 2001

(54) PREVENTING AIR ASPIRATION IN SLIDE GATE PLATE THROTTLING MECHANISMS

(75) Inventor: Mohammad Assar, Cleveland Heights, OH (US)

(73) Assignee: LTV Steel Company, Inc., Cleveland, OH (US)

( * ) Notice: Subject to any disclaimer, the term of this patent is extended or adjusted under 35 U.S.C. 154(b) by 0 days.

(21) Appl. No.: 09/495,976

(22) Filed: Feb. 2, 2000

(51) Int. Cl.[7] ..... B22D 41/08

(52) U.S. Cl. ..... 222/590; 222/600; 222/603; 266/45; 266/236

(58) Field of Search ..... 222/590, 600, 222/603; 266/236, 45, 275

(56) References Cited

U.S. PATENT DOCUMENTS 5,670,075 * 9/1997 Vassilicos ..... 222/603
5,676,195 * 10/1997 Vassilicos ..... 222/603
5,958,279 * 9/1999 Kawamura et al. ..... 222/600
6,016,940 * 1/2000 Florent et al. ..... 222/590

* cited by examiner

*Primary Examiner*—Scott Kastler
(74) *Attorney, Agent, or Firm*—Watts Hoffmann Fisher & Heinke

(57) ABSTRACT

A slide gate plate throttling mechanism for the continuous casting of molten metal includes a gate plate assembly. The gate plate assembly is connected to an upper nozzle disposed below a vessel for containing molten metal and is disposed above an elongated lower nozzle that directs flow of molten metal. Each plate of the gate plate assembly includes an opening that forms a portion of a passageway for the molten metal. The gate plate assembly comprises a gate plate that is moved so as to open and close the passageway, a lower plate connected to an upper surface of the nozzle, and a groove disposed in a bottom surface of the lower plate around the lower plate opening. The mechanism further comprises at least one control device for regulating flow of inert gas and graphite into the groove. The system may include a device for measuring back pressure in the groove to determine when to seal the groove by injecting graphite therein. Also included is a flowmeter that prevents air aspiration, the flowmeter being constructed and arranged so as to measure a flow rate of the inert gas in the groove even in the presence of the graphite. The flowmeter may be used in a method for quality control and maintenance of the gate system used in the continuous casting process.

23 Claims, 7 Drawing Sheets

PREVENTING AIR ASPIRATION IN SLIDE GATE PLATE THROTTLING MECHANISMS

FIELD OF THE INVENTION

The present invention relates to preventing air aspiration in slide gate plate throttling mechanisms and, in particular, to the control of graphite injection therein.

BACKGROUND OF THE INVENTION

In the continuous casting of steel, molten metal may be delivered to a mold by means of an upper tundish nozzle attached to the bottom of a tundish, a slide gate plate assembly below the upper tundish nozzle and a refractory tube below the slide gate plate assembly which is submerged in the molten metal. The refractory tube is referred to as a submerged entry nozzle. One form of slide gate plate assembly employs three plates: an upper plate affixed to the upper tundish nozzle, an apertured middle plate and a lower plate that is connected to the submerged entry nozzle. The flow of molten metal from the tundish through the upper tundish nozzle and into the submerged entry nozzle is regulated by sliding the middle plate so as to close or open its aperture. When the aperture of the middle plate is open, molten metal travels into the submerged entry nozzle and into the mold, whereas as it is closed it throttles molten metal flow. All of the components that come into contact with the molten metal are made of a refractory composition.

Another form of slide gate assembly includes two plates: an upper plate connected to the upper tundish nozzle and a movable gate plate to which the submerged entry nozzle is attached. In the case of the three plate gate assembly, the nozzle is stationary in the mold (the middle gate plate being movable), whereas in the two plate gate assembly the submerged entry nozzle is attached to the gate plate and moves along with it. Additional plates or nozzles may be used with the plate assemblies.

A slide gate plate assembly may also be used under a ladle. The assembly may include two or three plates and is very similar to the tundish gate plate assembly. In use on a ladle, the lower nozzle may be referred to as a shroud and feeds the tundish below it.

Aluminum is added to the steel composition to remove oxygen. While this may reduce or eliminate oxygen, it also has the undesirable effect of possibly clogging the passages of the submerged entry nozzle with accretions of refractory aluminum oxide. In conventional casting methods, nitrogen gas, argon gas, or a mixture of these gases is injected into various locations of the molten metal flow passage such as in the submerged entry nozzle, to scrub the build up of accretions of aluminum oxide on the inside of the passages and to prevent nonmetallic inclusions from adhering inside the passageway.

The system is designed to prevent air aspiration that leads to formation of the refractory deposits along the passageway and clogging. One way this is accomplished in the slide gate assemblies of both the tundish and ladle, is to employ a groove in the lower plate above the lower elongated nozzle (e.g., the submerged entry nozzle). Graphite containing nitrogen gas is injected into the groove periodically to seal the gap between the lower plate and lower nozzle in an attempt to avoid air aspiration. In the case of both the two and three plate gate assemblies, the lower plate remains in place as the submerged entry nozzle exchange apparatus periodically replaces nozzles. The graphite injection feature is used in conjunction with quick nozzle exchange mechanisms.

Conditions under which the graphite containing nitrogen gas is injected are conventionally determined by measuring the back pressure of the gas in the groove. Back pressure may be created by connecting to the groove a tubular coil through which the gas must pass after leaving the groove. Due to surface irregularities and roughness between the refractory material of the top of the elongated lower nozzle (e.g., the submerged entry nozzle) and the bottom of the bottom plate, air is still aspirated into the molten metal passageway, leading to clogging of the lower nozzle. In addition, non-metallic inclusions occasionally form in the molten metal due to air aspiration. When a slab produced by the continuous casting process is rolled into a thin strip, nonmetallic inclusions therein are lengthened, forming "slivers" which may require downgrading or scrapping of the steel containing the slivers. The problem of sliver formation is significant and not avoided by current graphite injection processes and back pressure monitoring or by making the abutting lower plate and lower nozzle surfaces very smooth in an attempt to decrease the gap.

Another persistent problem is the clogging of the nozzle below the graphite injection groove (e.g., the submerged entry nozzle). Such clogging requires occasional "rodding" by workers in which a long rod is rammed through the molten metal passageway to break up deposits of refractory therein. This is a hazardous process and disadvantageous in that dislodged accretions may find their way into the molten metal, which may require downgrading of the steel.

The continuous casting process would benefit from a system that prevents air aspiration between the bottom plate and the submerged entry nozzle, thereby producing better quality steel by reducing the instances of formation of "slivers" in the steel, and reducing the need for "rodding."

SUMMARY OF THE INVENTION

The present invention is directed to preventing air aspiration in slide gate plate mechanisms of the two or three plate type used with a ladle or tundish such as those that employ a quick exchange lower nozzle replacement device. The invention is used with components including an upper nozzle disposed below a vessel for containing molten metal, a slide gate plate assembly disposed below the upper nozzle and a lower elongated nozzle connected to the gate plate assembly. The gate plate assembly includes a lower plate that contacts the lower nozzle. A bottom surface of the lower nozzle has a groove. At least one control device regulates flow of inert gas and graphite into the groove. Particular back pressure measurements in the groove may be made to signal for the injection of graphite into the inert gas stream to seal the groove. The invention employs a mass flowmeter that measures the flow rate of the inert gas in the groove even in the presence of graphite therein. These flow rate measurements in the groove are indicative of clogging of the groove or of a device such as a coil that creates back pressure in the groove, and are used for quality control and maintenance of the slide gate plate mechanism during the continuous casting process. The present invention enables such problems to be identified using the flow rate measurements, which is not possible with conventional back pressure monitoring graphite injection devices.

One embodiment of the present invention is directed to a slide gate plate throttling mechanism for the continuous casting of molten metal comprising a gate plate assembly which is connected to a nozzle disposed below a vessel for containing molten metal (e.g., a tundish) and disposed above an elongated nozzle that directs flow of molten metal (e.g., a submerged entry nozzle). The gate plate is moved so as to open and close the passageway. The lower plate is connected to or abuts an upper surface of the nozzle, and the groove is disposed in a bottom surface of the lower plate around the passageway. The mechanism further comprises at least one control device for regulating flow of inert gas and graphite into the groove. The invention includes a flowmeter used to prevent air aspiration, the flowmeter being constructed and arranged so as to measure a flow rate of the inert gas in the groove even in the presence of the graphite.

More specific features of this embodiment include a device (such as a programmable logic controller) for displaying measured data indicative of the flow rate. A device such as the coil may be used for creating back pressure in the groove, and a device may be used for measuring the back pressure. The flowmeter is without a probe in the inert gas. The gate plate assembly may be a two or three plate assembly, which employs a lower nozzle quick exchange device.

A programmable logic controller is adapted to send signals to cause the control device to inject a desired amount of graphite into the groove in response to signals from the flowmeter indicating that a flow rate measured by the mass flowmeter is less than a predetermined flow rate. The programmable logic controller may also be adapted to send signals to cause the quick lower nozzle exchange apparatus to replace the lower nozzle in response to signals from the flowmeter indicating that a flow rate measured by the flowmeter is less than a predetermined flow rate. The programmable logic controller may also be adapted to send signals to cause the injection of pressurized gas into the groove and/or groove and coil in response to signals from the flowmeter indicating that a flow rate measured by the flowmeter is less than a predetermined flow rate.

The present invention offers numerous advantages compared to the prior art mechanisms that regulate graphite injection using back pressure measurements alone. The invention adds a quality control aspect to the continuous casting process. When the flow rate measurements indicate that clogging has occurred, this informs the operator that steel slabs made in the interval of clogging should be inspected. The invention also enables maintenance of the system to be carried out. The flow rate data informs the operator when the lower nozzle is aspirating air, so the operator may have it replaced. The flow rate data also indicates when the groove or coil are clogged so that the operator may send a jet of high pressure gas to unclog them. This prevents the system from being operated based upon false back pressure signals. For example, if the groove is clogged, the back pressure would be high, which suggests a tight seal. However, actual conditions may call for graphite injection to re-form the seal between the lower plate and lower nozzle. The flow rate data instructs the operator when conditions warrant an injection of graphite to re-form this seal. The operator may also perform other maintenance such as tightening of fittings in response to low flow rate data. Prior back pressure-only graphite injection processes are unable to carry out the inventive functions. As a result, use of the present invention results in significant decreases in instances of rodding, sliver formation and possibly the need for nozzle replacement.

Another embodiment of the present invention is directed to a method of preventing air aspiration in a slide gate plate throttling mechanism for the continuous casting of molten metal comprising directing molten metal from a vessel containing it (e.g., a tundish) through the upper nozzle disposed below the vessel, through openings in the gate plate assembly disposed beneath the upper nozzle, the gate plate being movable so as to restrict and permit molten metal flow therethrough, and through the elongated lower nozzle disposed below the lower plate (e.g., a submerged entry nozzle). A stream of inert gas is injected into the groove disposed around the opening in the bottom surface of the lower plate. Graphite is injected into the stream so as to direct it into the groove. A flow rate of the inert gas stream in the groove is measured even in the presence of the graphite.

More specific features of the method comprise monitoring the flow rate to determine when it is less than a predetermined flow rate (e.g., at least about 60% of an inlet flow rate upstream of the groove). Pressurized gas may be injected into the groove to remove clogging upon determining that the flow rate is less than the predetermined flow rate. The nozzle may be replaced when the flow rate is less than the predetermined flow rate. The graphite may be injected into the stream so as to direct the graphite into the groove upon determining that the flow rate is less than the predetermined flow rate. The flow rate measurements may be displayed on a programmable logic controller and monitored by an operator. Alternatively, a PLC is adapted to receive signals indicating that the flow rate is less than the predetermined flow rate and to send signals that cause at least one of the following to occur: (1) injection of pressurized gas into the groove to remove clogging; (2) an alarm or signal recommending that the operator replace the lower (e.g., submerged entry) nozzle and (3) injection of graphite into the inert gas stream so as to direct the graphite into the groove. The gate plate assembly is a two or three plate assembly. The mass flow measurement data are preferably used with back pressure data in the inventive method.

Additional features will become apparent and a fuller understanding obtained in view of the accompanying drawings and detailed description of preferred embodiments that follows.

DETAILED DESCRIPTION OF PREFERRED EMBODIMENTS

Figure 1:
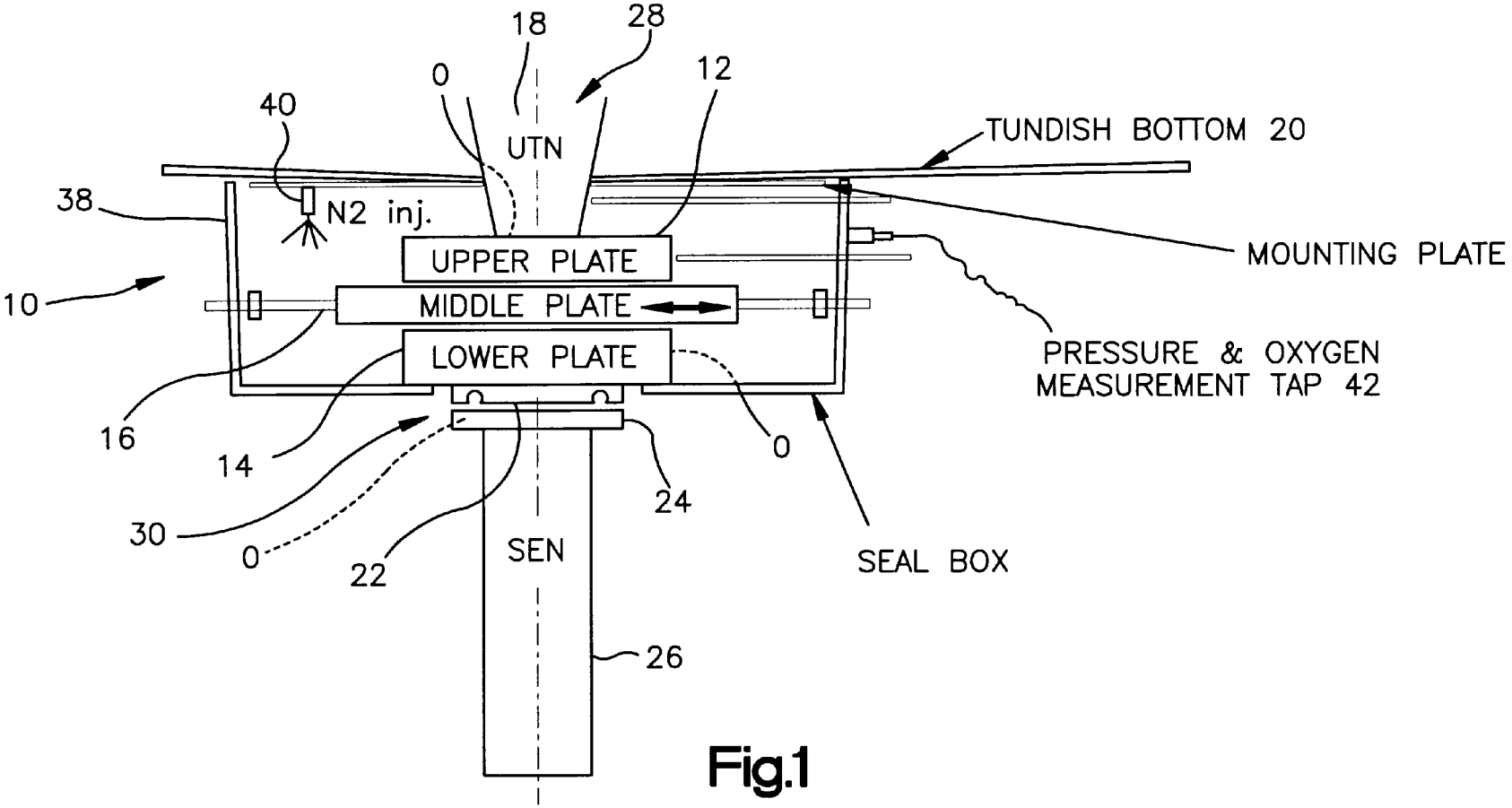
FIG. 1 is a schematic view showing a slide gate plate mechanism of a type in which the present invention may be employed.
Figure 2:
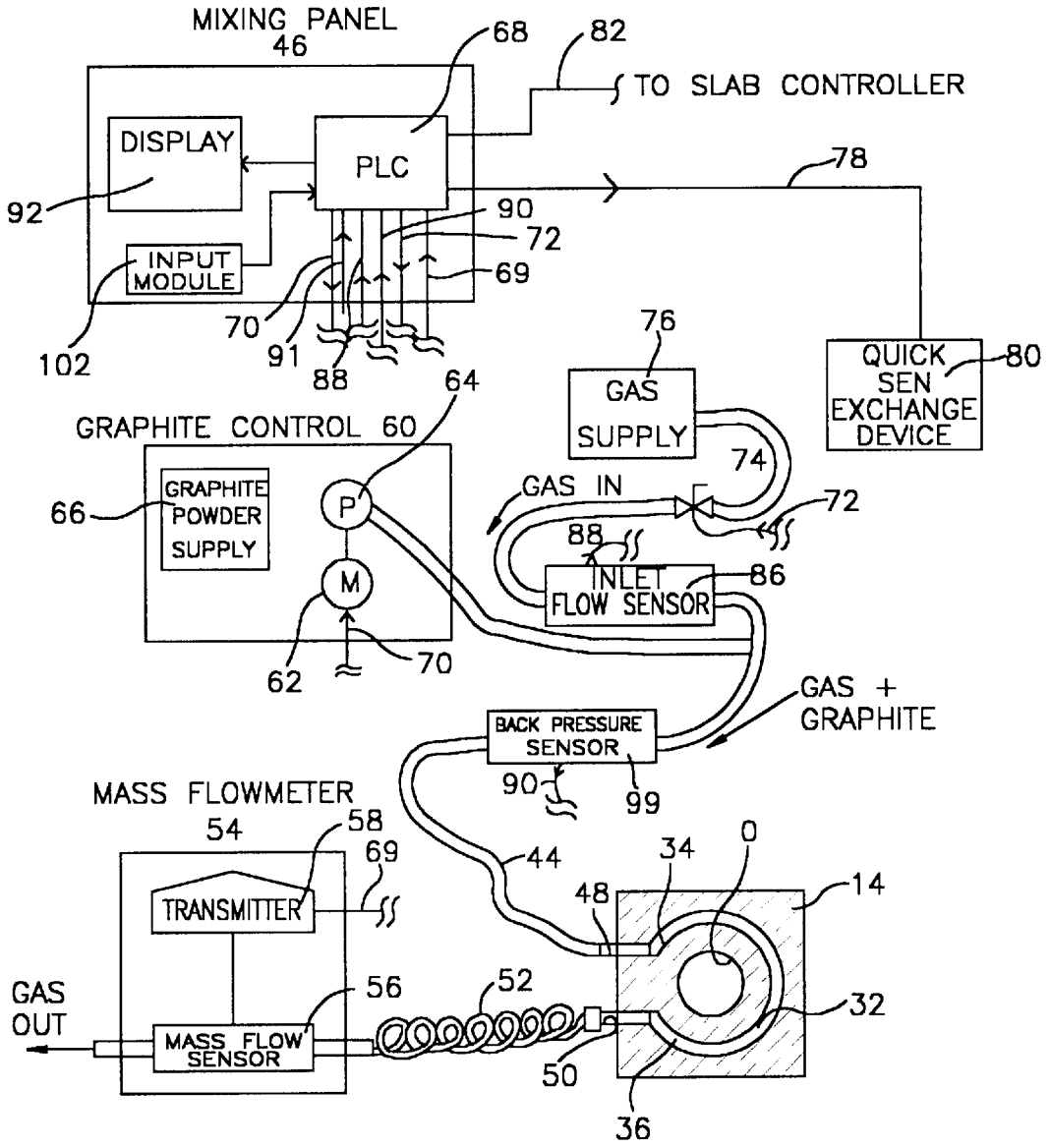
FIG. 2 is a schematic view and block diagram illustrating electrical components and other devices employed in connection with the present invention (arrows shown on conductors being provided to provide a general indication of a direction of electrical signal travel and not so as to limit the present invention to the particular directions shown)

Referring now to the drawings, the present invention is directed to preventing air aspiration in slide gate plate throttling mechanisms including a gate plate assembly 10 of the type that comprises an upper plate 12, a lower plate 14 and a middle slide gate plate 16 between the upper and lower plates. The upper plate 12 is connected to an upper tundish nozzle 18 fastened to a tundish 20. The lower plate includes a flat bottom surface 22 which abuts against and is connected to a flat upper surface 24 of an upper portion of a submerged entry nozzle ("SEN") 26. A molten metal passageway 28 is formed by the upper tundish nozzle, by openings O in the plates of the gate plate assembly and by the SEN. The openings in the plates and nozzles are vertically aligned and the components are fastened together and to the tundish in a known manner to permit the flow of molten metal from the tundish into the mold of a continuous casting apparatus. The gate plate slides between the upper and lower plates to throttle the flow of molten metal into the mold in the known manner. Between the bottom surface 22 of the lower plate and the upper surface 24 of the SEN is an unavoidable gap 30 (the size of which is greatly exaggerated in the figure for purposes of illustration). The gap is due to scratches or irregularities of surfaces 22 and 24, possibly even at a microscopic level, and cannot be reduced to a degree that prevents air from entering the passageway. A vacuum is formed due to the high throughput of molten metal traveling along the passageway, which tends to cause air aspiration by pulling air from outside the components in through the gap. A groove 32 is disposed in a bottom surface of the lower plate. As shown in FIG. 2 this groove has a shape (such as the C-shape shown) so as to at least partially surround the opening O in the lower plate and to have an entrance portion 34 and exit portion 36. Nitrogen containing gas (e.g., 100% nitrogen) is directed into the groove to seal the gap with graphite and thereby prevent air aspiration. The present invention monitors the flow rate of the gas in the groove as well as back pressure in the groove, to determine when clogging may have occurred, which may lead to air aspiration and the formation of slivers in the steel. Remedial measures may be taken in response to this information in accordance with the present invention.

In a preferred embodiment, the slide gate plate throttling mechanism uses the three plate gate assembly shown and described in connection with a tundish. However, the invention may be applicable to ladles or tundishes, and to two plate or three plate gate assemblies such as the type that employ a quick nozzle exchange apparatus. For other gate plate assemblies in which the present invention may be suitably used, for example, one may refer to U.S. patent application Ser. No. 09/126,617, filed Jul. 31, 1998, entitled, "Preventing Pencil Pipe Defects in Steel," which is incorporated herein by reference in its entirety.

A seal box 38 may be disposed in a conventional manner so as to sealingly contain in an inert gas the components that are above the lower plate. The inert gas, for example, nitrogen, is injected into the box at 40. Other components may be used in connection with use of the seal box, such as a pressure and oxygen measurement tap 42 as is known in the art. The seal box does not contain the joint between the lower plate and SEN because of the need for frequent replacement of the SEN.

The groove is disposed around the opening O in the lower plate and spaced radially outward therefrom by several millimeters, for example. A flexible gas inlet conduit 44 such as a rubber hose is coupled to a metal inlet tube 48, which is secured in the groove 32 in the known manner. A metal outlet tube 50 is secured in another portion of the groove and a metal helical tube ("coil") 52 is coupled thereto in the known manner.

A gas mixing/control panel 46 is a gas regulation device such as that commercially available from Air Products Model No. 971207A, and as discussed below, interacts with and/or comprises suitable valves, sensors, gauges, a programmable logic controller and circuitry to select one or combinations of gases (such as nitrogen and argon) used in various locations of the slide gate plate assembly, the upper tundish nozzle, the SEN and the seal box, and to display and utilize groove flow rate and back pressure measurements. Nitrogen gas flows continuously into the groove for enabling the back pressure measurements. The mixing panel typically signals for the use of 10 liters per minute flow rate of nitrogen gas to the groove.

A mass flowmeter 54 is disposed at an outlet of the coil 52. Not all mass flowmeters are suitable for use in the present invention. One example of a mass flowmeter that is unsuitable for use in the present invention is a rotameter commercially available from Dawyer™ Model No. VFA-4, which cannot measure flow rate in the graphite environment. Suitable mass flowmeters include those that are without a probe in the inert gas, since mass flowmeters that include a probe are damaged by the presence of the graphite in the gas. One suitable mass flowmeter is a probeless mass flowmeter commercially available from Micromotion™, which includes a sensor 56 connected to the coil (Model No. CMF010M324NU) and an electrical transmitter 58 (Model No. RFT9739E4SUJ). This flowmeter is calibrated for a range of flow of 0–30 liters of nitrogen gas per minute and measures mass flow on the principle of the coriolis force.

A graphite injection control device 60, such as that commercially available from Vesuvius™, is disposed along the gas line 44 upstream of the groove for injecting graphite into the nitrogen gas stream. The graphite control device includes a motor 62 and a screw type pump 64 (such as that commercially available from Vesuvius™ Powder Injection Motor Box Model No. PE1, 4N28601310) that sends a metered amount of graphite from a graphite powder supply 66 into the gas stream in the line 44 leading to the groove. The motor is electrically coupled to the pump and, when activated, causes the screw pump to rotate by a precise amount as instructed by signals from a programmable logic controller 68 in the mixing panel 46. Rotation of the screw pump takes powdered graphite from the supply 66 and directs it into the line 44 where the nitrogen flow entrains it into the groove and in the gap between the lower plate and the top surface of the SEN to avoid air aspiration into the molten metal passageway. Some graphite is lost through the gap between the bottom of the lower plate and top of the SEN, radially outward of the groove to the atmosphere and radially inward of the groove into the molten metal flow.

A flow rate set point is predetermined at which the particular slide gate plate mechanism will operate effectively without clogging. When the flow rate drops below this value, it is indicative of a potential problem. For example, the groove or coil tube may be clogged with refractory pieces from the slide gate mechanism components or by agglomerated graphite. A drop in back pressure when flow of molten metal increases, may be indicative of a poor joint between the lower plate and SEN.

In response to a signal falling below the flow rate set point, various remedial actions may be taken. One step is to inject graphite into the stream to seal the gap between the lower plate and entry nozzle. The graphite injected in the present invention may be more or less than that injected in prior practices which base injection solely on back pressure measurements. On the one hand, back pressure measurement based graphite injection may occur too often; at times flow rate measurements may indicate injection is not needed. On the other hand, the flow rate measurements may require graphite injection at times when a conventional back pressure measurement system would not have injected graphite.

Another step is to inject a relatively high pressure jet of nitrogen clearing gas into the groove to remove clogging in the groove and coil. Yet another step is to clear the molten metal flow passageway as by "rodding." When rodding is carried out, resultant steel slabs should be inspected. Monitoring throughput of the molten metal passing from the SEN enables one to determine whether there are leaks. If throughput increases and back pressure decreases, it is an indication that there is a leak. Another step is to replace the SEN. Also, the inlet conduit fittings may be tightened. One skilled in the art may empirically determine whether to carry out one or more of these remedial measures and the particular order, in view of the present disclosure.

Those skilled in the art will appreciate that the tundish slide gate plate mechanism is subject to vibration caused by movement of the gate plate and to creep of the refractory components. The gate moves frequently as it is a slave to a predetermined mold level set point. This frequent movement may change the gap. Also, the molten metal may erode the refractory components. Increasing of the gap between the lower plate and SEN, due possibly to vibration of the system or to localized thermal stresses, contributes to air aspiration. Graphite injected into the groove is also lost to the atmosphere and molten metal flow. As a result of these factors, after a period of time graphite that has been injected into the groove is no longer effective in preventing air aspiration and must be injected again into the nitrogen stream to be deposited into the groove. Graphite injection may occur at different frequency and duration as a result of the wear and operation of the system. The replacement of the lower or SEN leads to air aspiration, since air enters the molten metal as the new SEN is slid into position. The present invention should be employed in connection with lower nozzle quick exchange systems that change the nozzle relatively quickly (preferably on the order of seconds rather than minutes) so as to avoid significant air aspiration. In addition, clogs may be formed at different times throughout the process. Despite all of these varying conditions of the process, the present invention, through monitoring of the back pressure and flow rate, enables a problem condition to be determined and timely remedial action to be taken throughout various stages of continuous casting (i.e., tundish change, tundish nozzle change, SEN change, wear of the components, and the like).

The function of the operator may be replaced by automated operation using the PLC 68. The flow rate measurement signals from the transmitter 58 of the mass flowmeter 54 may be sent to the PLC 68 of the mixing panel 46 via radio frequency (RF) or a hard wire conductor. The PLC 68 is programmed to send one or more signals to take appropriate remedial action. For example, the PLC may send a signal along a conductor 70 to the motor 62, instructing the injection of a particular amount of graphite into the groove. The PLC 68 may direct a signal along a conductor 72 to a valve or valves 74, causing release of a relatively high pressure jet of gas from a gas supply 76 into the groove and coil to unclog them. The PLC 68 may send a signal along a conductor 78 to a quick SEN exchange apparatus 80, recommending that the operator use the quick exchange apparatus to replace the SEN. The PLC may also send a signal along a conductor 82 to another controller (not shown) that will cause rerouting of suspect slabs for inspection. The PLC 68 may receive inlet flow rate data from an inlet flow sensor 86 disposed along the line 44 via a conductor 88. Information as to groove back pressure measurements from a back pressure sensor 99 along conductor 90, inlet and groove flow rates, throughput of molten metal along the passageway (as fed into the PLC 68 from another sensor (not shown) along conductor 91), may be displayed on a display 92 as raw data or in graphical form. The PLC 68 would be suitably programmed via a PLC input module 102 to achieve these desired functions. It should be understood that the relative locations of the electrical components shown in FIG. 2 may be changed by one skilled in the art without departing from the spirit of the invention.

In the present invention, a normal range of back pressure is 4–7 psi. Back pressure should be approximately at least equal to the system pressure plus 3 psi. Indications of "low back pressures" throughout this disclosure refer to those pressures less than: system back pressure plus 3 psi. For example, the system pressure in one system (i.e., line pressure comprised of a particular length, size and/or characteristics of hose, inlet tube, outlet tube, coil, graphite injection device, mass flowmeter, and various fittings) was about 4 psi (2 psi due to the coil and 2 psi due to the other components that comprise the line), resulting in a preferred back pressure of at least 7 psi. Of course, the line pressure may vary due to factors such as the length of the line and the particular fittings used.

The flow rate setpoint is preferably a flow rate in the groove that is at least about 60% of the inlet flow rate of the gas upstream of the groove (e.g., at least about 6 liters per minute). The flow rate is measured at times when no graphite is injected into the groove as well as at times while there is graphite in the gas. The graphite containing nitrogen gas flow rate is not expected to be significantly different than the inert gas-only flow rate.

One aspect of the invention is monitoring the flow rate of the nitrogen or nitrogen/graphite stream and using this information to regulate the injection of graphite. The following provides exemplary information in this regard. Very low or nonexistent flow rates (e.g., less than 2 liters/minute or 20% of the input flow rate) are an indication of looseness of the SEN/lower plate joint and a potential indication of air aspiration. High flow rates (e.g., greater than 6 liters/minute or 60% of the input flow rate) are an indication of a tight SEN/lower plate joint and no air aspiration. When the output flow is low (e.g., less than 6 liters per minute or 60% of the input flow rate), graphite is injected via the stream of nitrogen into the groove. The injection continues until the graphite has sealed/eliminated the source of air aspiration and the output nitrogen flow reaches the set point (e.g., 6 liters /minute or 60% of the input flow rate). In the fully automated system, if the PLC 68 is used it would control the graphite injection process when the output flow is below the set point. Alternatively, the measurements from the mass flowmeter may be read by an operator on the display 92. If the measured flow rate of the inert gas alone or with graphite is less than 60% of the corresponding inlet flow rate upstream of the groove, the operator can take the appropriate remedial action.

Another aspect of the invention is monitoring the nitrogen gas/graphite flow rate and back pressure in the groove and using this information to schedule preventative maintenance of the graphite injection system to maximize its effectiveness, and to reroute slabs to check quality. The following provides exemplary information in this regard. If the groove back pressure is high (e.g., greater than 8 pounds per square inch ("psi")) but the groove output flow rate is very low (e.g., less than 2 liters/minute or 20% of the input flow rate) it is an indication that the graphite injection lines are clogged. To correct high back pressure, the groove and coil should be cleaned. If both groove back pressure and flow rate are low (e.g., less than 3 psi back pressure, less than 2 liters/minute or 20% of the inlet flow rate), it is an indication that the nitrogen coil or fittings in the lines are loose. Fittings should be immediately wrench tightened. If the gas pressure and flow rate do not increase after tightening, it is an indication that the SEN/lower plate joint is loose, a remedy being injection of more graphite. When gas pressure and flow rate do not increase after tightening, currently cast steel slabs should be flagged for suspected quality concerns. If the output flow rate is similar to the input flow rate (e.g., greater than 8 liters/minute or 80% of the input flow rate), but the back pressure is high (e.g., greater than 8 psi), it is an indication that there is a restriction in the line, and the operator should examine the system during the next tundish change. If the groove back pressure is within a normal range, but the output flow is zero, it is an indication that air is being entrained into the SEN, and the slabs should be rerouted and inspected.

The invention will now be described with respect to the following nonlimiting examples.

EXAMPLE 1

Figure 3:
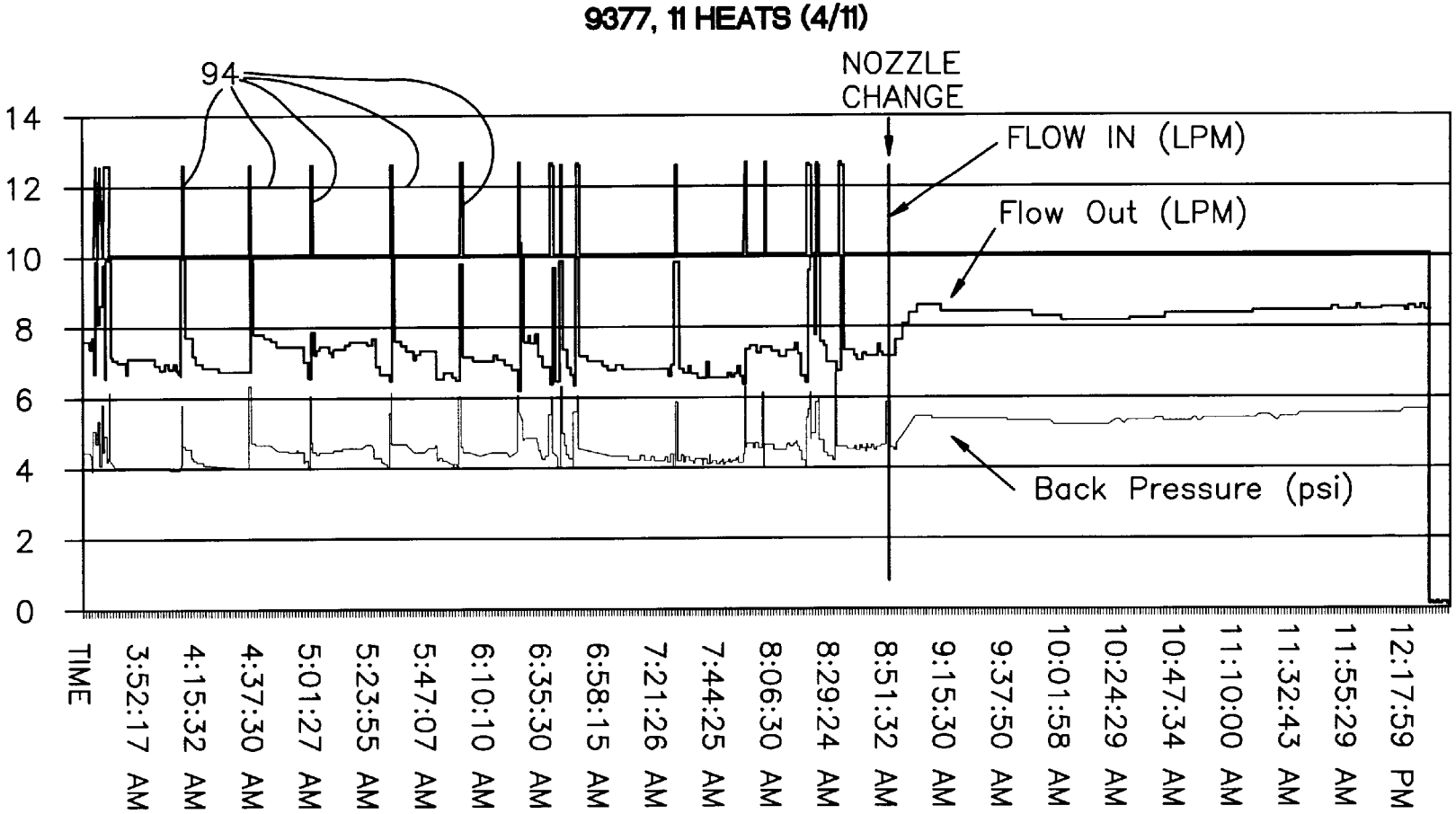
FIG. 3 is a graph depicting back pressure and flow rate during graphite injection.

FIG. 3 shows the results of successful graphite injection. Eleven heats were carried out in the time frame shown. The peaks 94 that occurred (some of which are labeled in the figure) indicate when graphite was injected into the nitrogen stream. The effect of the graphite was to improve tightness or the seal between the lower plate and the SEN. After each injection, the outflow rate increased.

EXAMPLE 2

Figure 4:
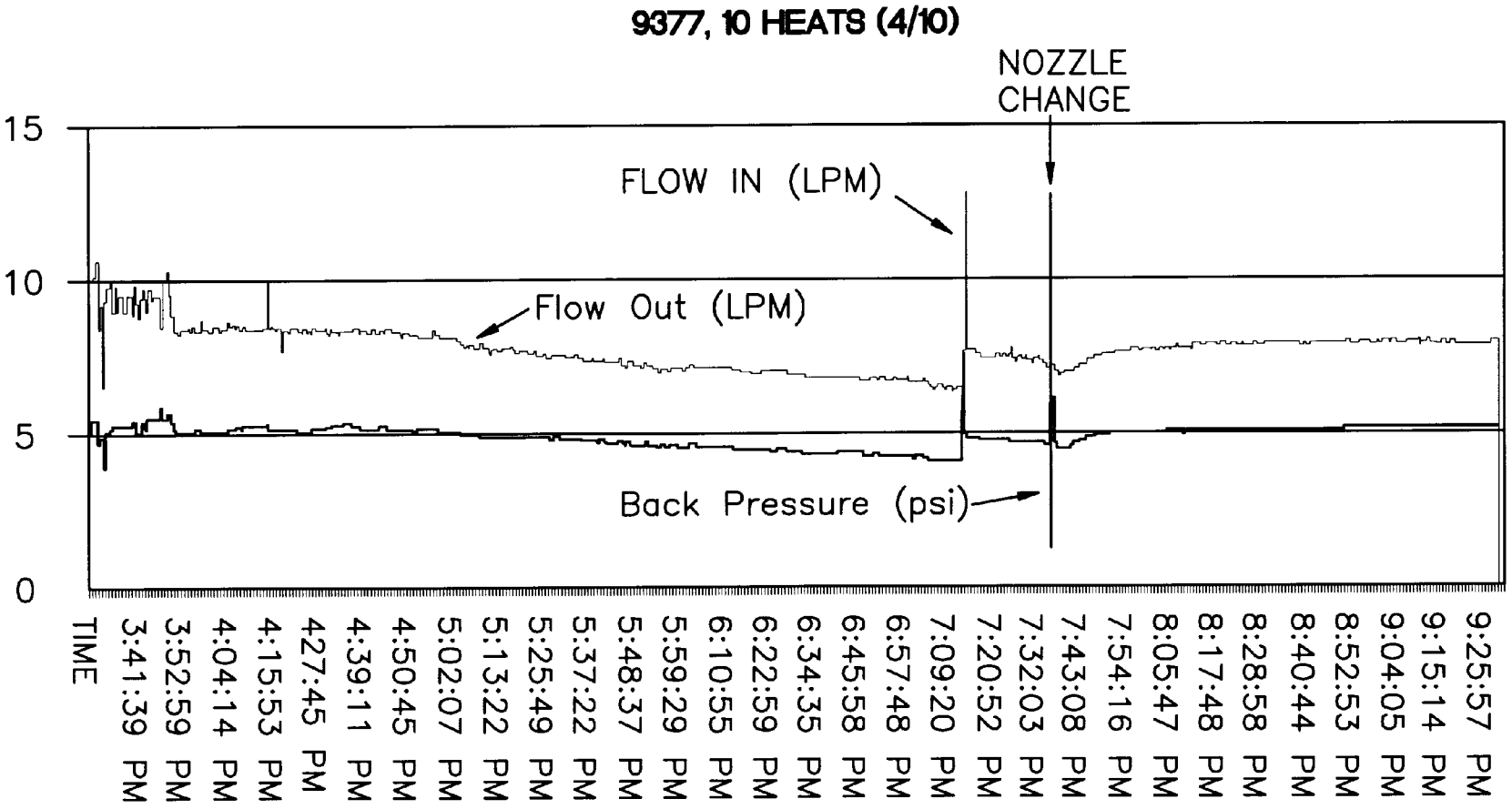
FIG. 4 is another graph depicting flow rate and back pressure during graphite injection.

FIG. 4 shows the effect of successful graphite injection. Ten heats were conducted in the time frame shown. Once the outflow rate decreased to about 6 liters per minute, graphite was injected and the outflow rate increased. The outflow rate increased again at the nozzle change.

EXAMPLE 3

Figure 5:
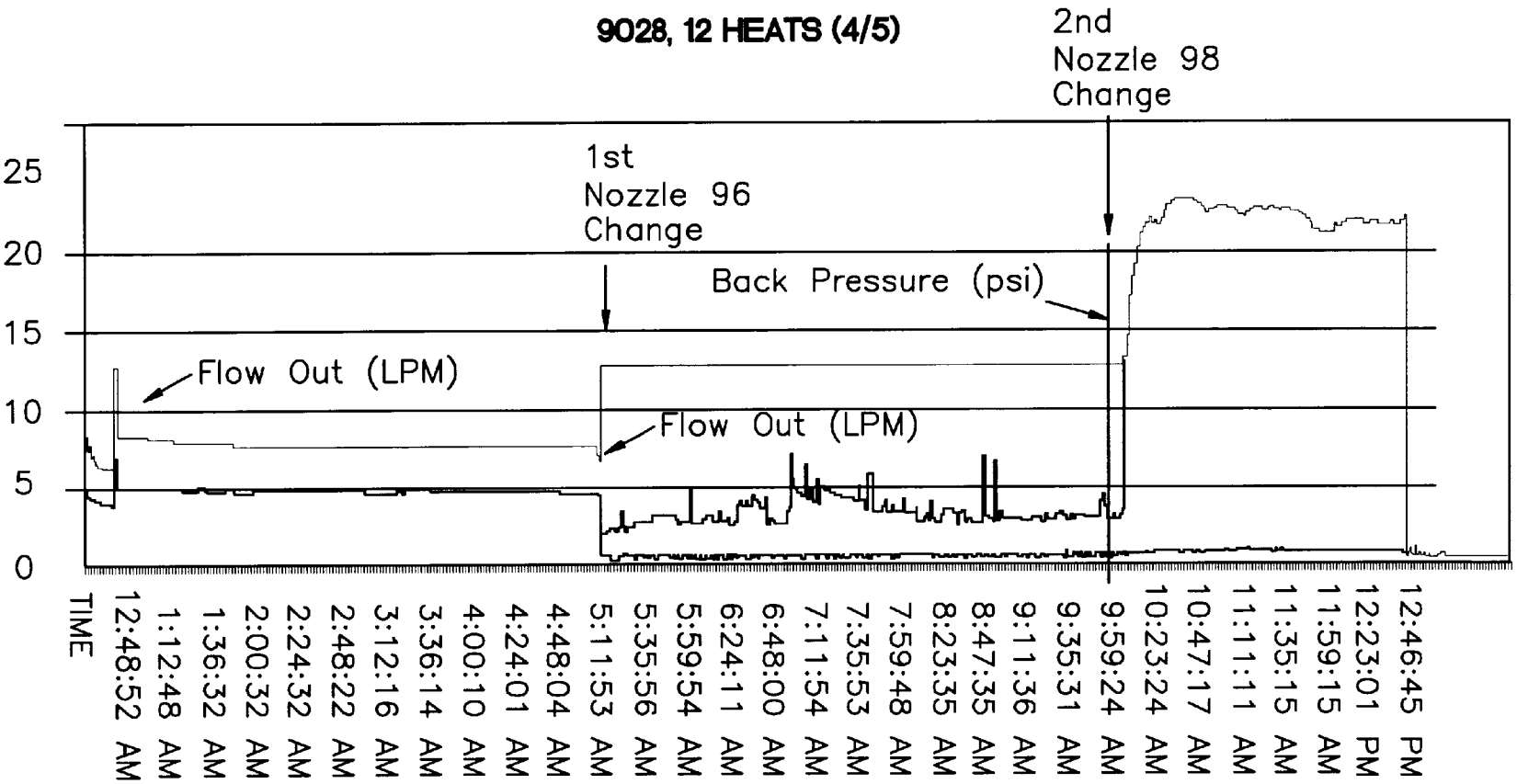
FIG. 5 is a graph illustrating an example of an effect of nozzle change on flow rate and back pressure.

FIG. 5 illustrates the inability of back pressure alone to predict problems in the tundish slide gate mechanism. Twelve heats were carried out in the time frame shown. The system was running well up to the first nozzle change. Flow rate in the groove was at least 60% (i.e., at least 6 liters/minute with a 10 liters/minute inlet flow rate) and the back pressure was good (i.e., about 5 psi). At the first nozzle change shown generally at 96, back pressure was lower and erratic. The flow rate was zero, which indicated a problem. In this instance it was concluded that the nozzle was scratched during the change and leaking occurred. After the second nozzle change shown generally at 98, the back pressure increased dramatically, implying clogging. Outflow rate was still about zero even after the second nozzle change.

EXAMPLE 4

Figure 6:
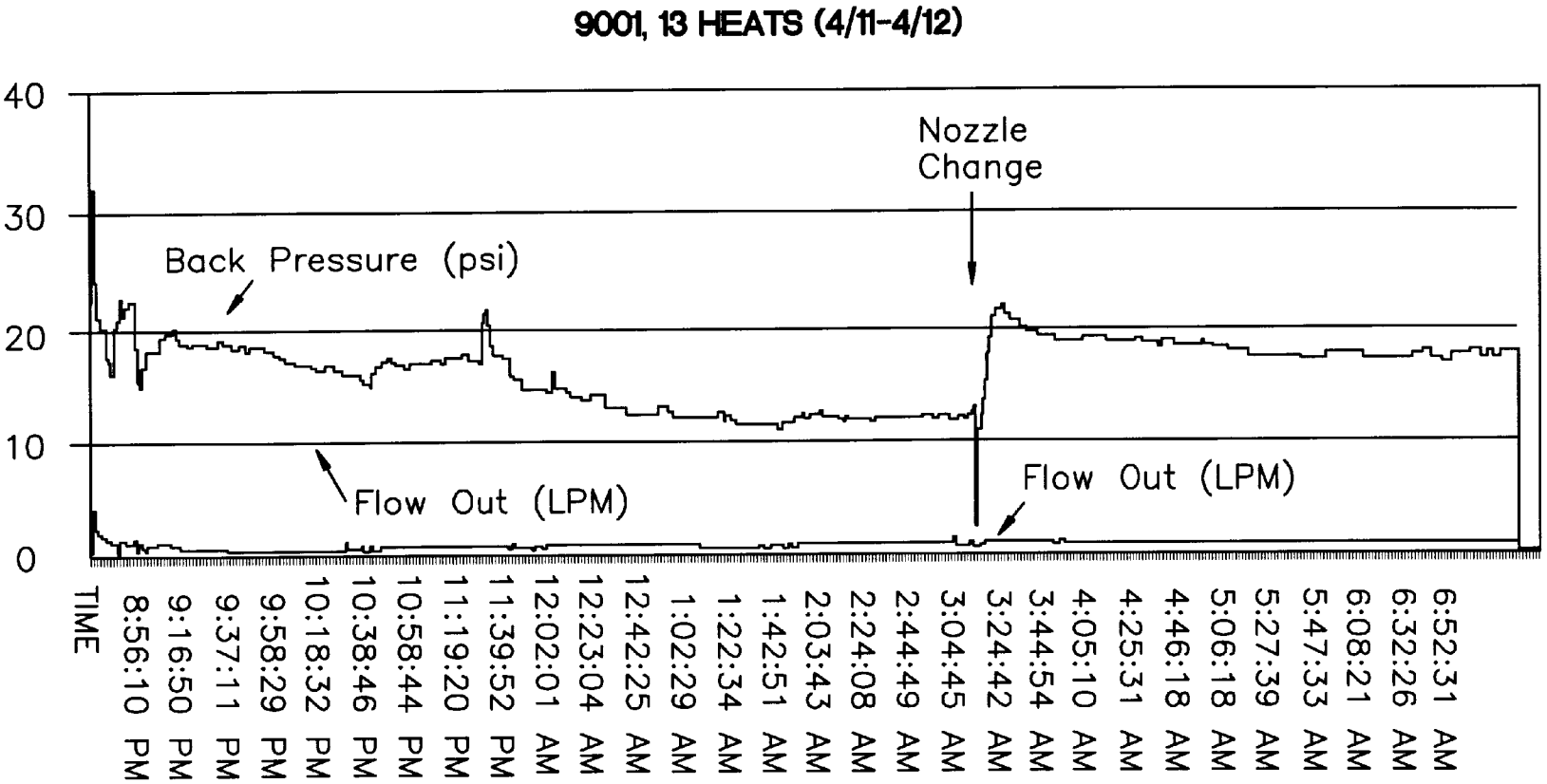
FIG. 6 is a graph illustrating an effect of groove clogging on back pressure and flow rate.

FIG. 6 illustrates operation in which the groove was clogged from the outset. Thirteen heats were conducted in the time frame shown. Back pressure was high throughout the heats, which suggests acceptable operation and a tight seal between the lower plate and SEN. However, the outflow rate was about zero throughout these heats, even after the nozzle change. Thus, the outflow provided valuable information about the need to remove clogging to avoid air aspiration. This important information was not provided by back flow readings alone.

EXAMPLE 5

Figure 7:
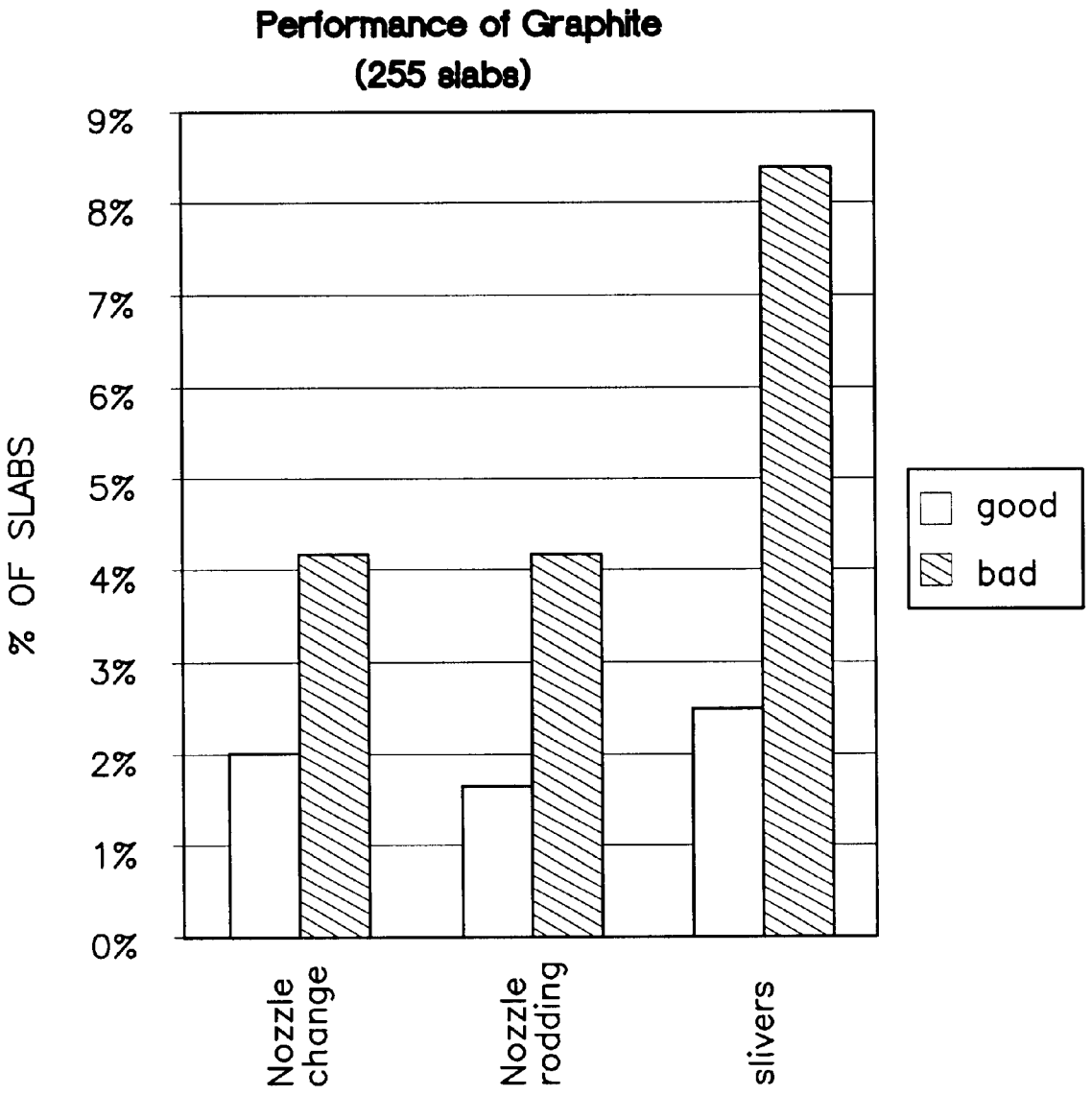
FIG. 7 is a graph illustrating a difference in performance in amount of slivers, instances of nozzle rodding and instances of SEN change in a prior art slide gate throttling mechanism and in slide gate throttling mechanisms operated in accordance with the present invention.

FIG. 7 illustrates the improved results of a tundish slide gate plate mechanism according to the present invention in the production of 255 slabs of steel. The percentage of slabs exhibiting slivers using the inventive process decreased from above 8% to below 3%, representing a decrease of over 70% in the amount of slivers. Instances of nozzle rodding decreased from above 4% to below 2% using the inventive process, representing a decrease of over 57% in instances of rodding. Instances of SEN change decreased from over 4% to almost 2% in the inventive process, representing a decrease of over 50% in instances of SEN change.

Although the present invention has been described with a certain degree of particularity, it should be understood that those skilled in the art can make various changes to it without departing from the spirit or scope of the invention as hereafter claimed.

What is claimed is:

1. In a slide gate plate throttling mechanism for the continuous casting of molten metal comprising a gate plate assembly which is connected to a nozzle disposed below a vessel for containing molten metal and is disposed above an elongated lower nozzle that directs flow of molten metal, each plate of said gate plate assembly including an opening that forms a portion of a passageway for the molten metal, said gate plate assembly comprising a gate plate that is moved so as to open and close said passageway, a lower plate connected to an upper surface of said lower nozzle, and a groove disposed in a bottom surface of said lower plate around said passageway, said mechanism further comprising at least one control device for regulating flow of inert gas and graphite into said groove, said improvement comprising a flowmeter that prevents air aspiration, said flowmeter being constructed and arranged so as to measure a flow rate of said inert gas in said groove even in the presence of said graphite.

2. The improvement of claim 1 comprising means for displaying measured data indicative of said flow rate.

3. The improvement of claim 1 comprising means for creating back pressure in said groove, and means for measuring said back pressure.

4. The improvement of claim 2 wherein said means for displaying measured data comprises a programmable logic controller.

5. The improvement of claim 1 wherein said flowmeter is without a probe in said inert gas.

6. The improvement of claim 1 wherein said gate plate assembly is a two plate assembly.

7. The improvement of claim 1 wherein said gate plate assembly is a three plate assembly.

8. The improvement of claim 1 wherein said vessel is a tundish.

9. The improvement of claim 1 comprising a programmable logic controller adapted to send signals to cause said control device to inject a desired amount of graphite into said groove in response to signals from said mass flowmeter indicating that a flow rate measured by said mass flowmeter is less than a predetermined flow rate.

10. The improvement of claim 1 comprising quick change means for replacing said lower nozzle and a programmable logic controller adapted to send signals recommending that the operator cause said quick change means to replace said lower nozzle in response to signals from said mass flowmeter indicating that a flow rate measured by said mass flowmeter is less than a predetermined flow rate.

11. The improvement of claim 1 comprising a programmable logic controller adapted to send signals to cause said control device to inject pressurized gas into said groove in response to signals from said mass flowmeter indicating that a flow rate measured by said mass flowmeter is less than a predetermined flow rate.

12. A method of preventing air aspiration in a slide gate plate throttling mechanism for the continuous casting of molten metal comprising:

directing molten metal from a vessel containing it through an upper nozzle disposed below said vessel, through openings in a gate plate assembly disposed beneath said upper nozzle that can restrict and permit molten metal flow therethrough, said gate plate assembly including a lower plate, and through an elongated lower nozzle disposed below and connected to said lower plate;

injecting a stream of inert gas into a groove disposed around an opening in a bottom surface of said lower plate;

injecting graphite into said stream so as to direct said graphite into said groove; and measuring a flow rate of said inert gas stream in said groove even in the presence of said graphite.

13. The method of claim 12 comprising monitoring said flow rate to determine when said flow rate is less than a predetermined flow rate.

14. The method of claim 13 wherein said predetermined flow rate is at least about 60% of an inlet flow rate upstream of said groove.

15. The method of claim 13 comprising injecting pressurized gas into said groove upon determining that said flow rate is less than said predetermined flow rate.

16. The method of claim 13 comprising replacing said lower nozzle upon determining that said flow rate is less than said predetermined flow rate.

17. The method of claim 13 comprising injecting said graphite into said stream so as to direct said graphite into said groove upon determining that said flow rate is less than said predetermined flow rate.

18. The method of claim 12 wherein said flow rate measurements are monitored by a programmable logic controller which is adapted to receive signals indicating that said flow rate is less than said predetermined flow rate and to thereby send signals that cause at least one of the following to occur: (1) injection of pressurized gas into said groove; (2) recommending that an operator cause a replacement of said lower nozzle and (3) injection of graphite into said stream so as to direct said graphite into said groove.

19. The method of claim 12 comprising displaying data indicative of said flow rate using a programmable logic controller.

20. The method of claim 12 wherein said vessel is a tundish.

21. The method of claim 12 wherein said gate plate assembly is a two plate assembly.

22. The method of claim 12 wherein said gate plate assembly is a three plate assembly.

23. The method of claim 12 comprising measuring back pressure in said groove.

* * * * *